US005179326A

United States Patent [19]

Nilssen

[11] Patent Number: 5,179,326

[45] Date of Patent: Jan. 12, 1993

[54] ELECTRONIC BALLAST WITH SEPARATE INVERTER FOR CATHODE HEATING

[76] Inventor: Ole K. Nilssen, Caesar Dr., Rte. 5, Barrington, Ill. 60010

[21] Appl. No.: 594,678

[22] Filed: Oct. 9, 1990

Related U.S. Application Data

[63] Continuation of Ser. No. 910,729, Sep. 23, 1986, abandoned.

[51] Int. Cl.[5] ..... H05B 41/36

[52] U.S. Cl. ..... 315/106; 315/107; 315/209 R; 315/DIG. 5; 315/DIG. 7

[58] Field of Search ..... 315/106, 225, 209 R, 315/DIG. 5, DIG. 7, 107

[56] References Cited

U.S. PATENT DOCUMENTS

| | | | |
|---|---|---|---|
| Re. 31,758 | 12/1984 | Nilssen | 331/113 A |
| 2,170,448 | 8/1939 | Edwards | 315/106 |
| 3,383,554 | 5/1968 | Oglesbee | 315/311 |
| 4,009,412 | 2/1977 | Latassa | 315/106 |
| 4,256,992 | 3/1981 | Luursema | 315/226 X |
| 4,438,372 | 3/1984 | Zuchtriegel | 315/224 |
| 4,461,980 | 7/1984 | Nilssen | 315/225 |
| 4,513,364 | 4/1985 | Nilssen | 363/132 |
| 4,554,487 | 11/1985 | Nilssen | 315/224 |
| 4,588,924 | 5/1986 | Luursema et al. | 315/107 |
| 4,622,496 | 11/1986 | Dattilo et al. | 315/106 X |
| 4,682,080 | 7/1987 | Ogawa et al. | 315/106 X |

*Primary Examiner*—Eugene R. LaRoche
*Assistant Examiner*—Son Dinh

[57] ABSTRACT

A high-frequency electronic ballast for fluorescent lamps has a first inverter for controllably providing heating power to the lamp cathodes and a second inverter for controllably providing main lamp operating power. The two inverters are separately and independently controllable, thereby: i) to permit adjustment of lamp current so as to provide full or reduced light output in accordance with requirements, ii) to permit cathode heating power to be removed under conditions of providing full light output, thereby to maximize efficiency, and iii) to permit cathode heating power to be restored under conditions of reduced light output, thereby to prevent premature lamp failure.

20 Claims, 1 Drawing Sheet

ELECTRONIC BALLAST WITH SEPARATE INVERTER FOR CATHODE HEATING

BACKGROUND OF THE INVENTION

1. Field of Invention

The present invention relates to dimmable- electronic ballasts for fluorescent lamps, particularly of a kind wherein cathode heating power is removed during periods of full light output and restored during periods of reduced light output.

2. Elements of Prior Art

Fluorescent lamp ballasts designed to permit wide-range control of light output provide cathode heating at all times; otherwise, during periods of reduced light output, lamp life would be seriously foreshortened.

Yet, as is well known, efficiency may be significantly improved by removing cathode heating power, especially during periods of full light output.

As is also well known, during periods of full light output, cathode heating power may be removed without suffering serious foreshortening of lamp life.

SUMMARY OF THE INVENTION

Objects of the Invention

An object of the present invention is that of providing an improved controllable ballast for fluorescent lamps.

These, as well as other objects, features and advantages of the present invention will become apparent from the following description and claims.

Brief Description

In its preferred embodiment, the present invention constitutes a power-line-operated ballast for two fluorescent lamps. This ballast comprises: i) a main self-oscillating half-bridge inverter whose high-frequency squarewave output voltage :s frequency-adjustable and connected with a series-resonant L-C circuit, and ii) an auxiliary controllable self-oscillating half-bridge inverter whose 30 kHz output voltage is connected with the primary winding of an auxiliary transformer.

The lamps are series-connected across the tank capacitor of the L-C circuit. A voltage-limiting Varistor is also connected across the tank capacitor. The lamps' cathodes are connected with individual outputs of the auxiliary transformer.

When power is initially applied to the ballast, only the auxiliary inverter is initiated into oscillation, thereby providing heating power to the lamp cathodes. About 1.5 second later, the main inverter is also initiated into oscillation, and the lamps then ignite in ordinary Rapid-Start manner.

The frequency, and thereby the power output, of the main inverter is adjustable by application of an adjustable control voltage. Thus, the magnitude of the arc current as well as the light output level of the fluorescent lamps are therefore correspondingly adjustable.

The flow of lamp arc current is used to control operation of the auxiliary inverter. At full lamp current, the oscillation of the auxiliary inverter is inhibited, thereby eliminating the flow of cathode heating power. At reduced lamp current, the auxiliary inverter is reinitiated into operation, thereby restoring the provision of cathode heating power.

As a consequence, substantial energy savings are possible under conditions of full light output without giving rise to any significant reduction in lamp life; yet light dimming is permitted without suffering the substantial foreshortening of lamp life associated with not providing cathode heating power during periods of reduced light output.

DESCRIPTION OF THE PREFERRED EMBODIMENT

Details of Construction

Figure 1:
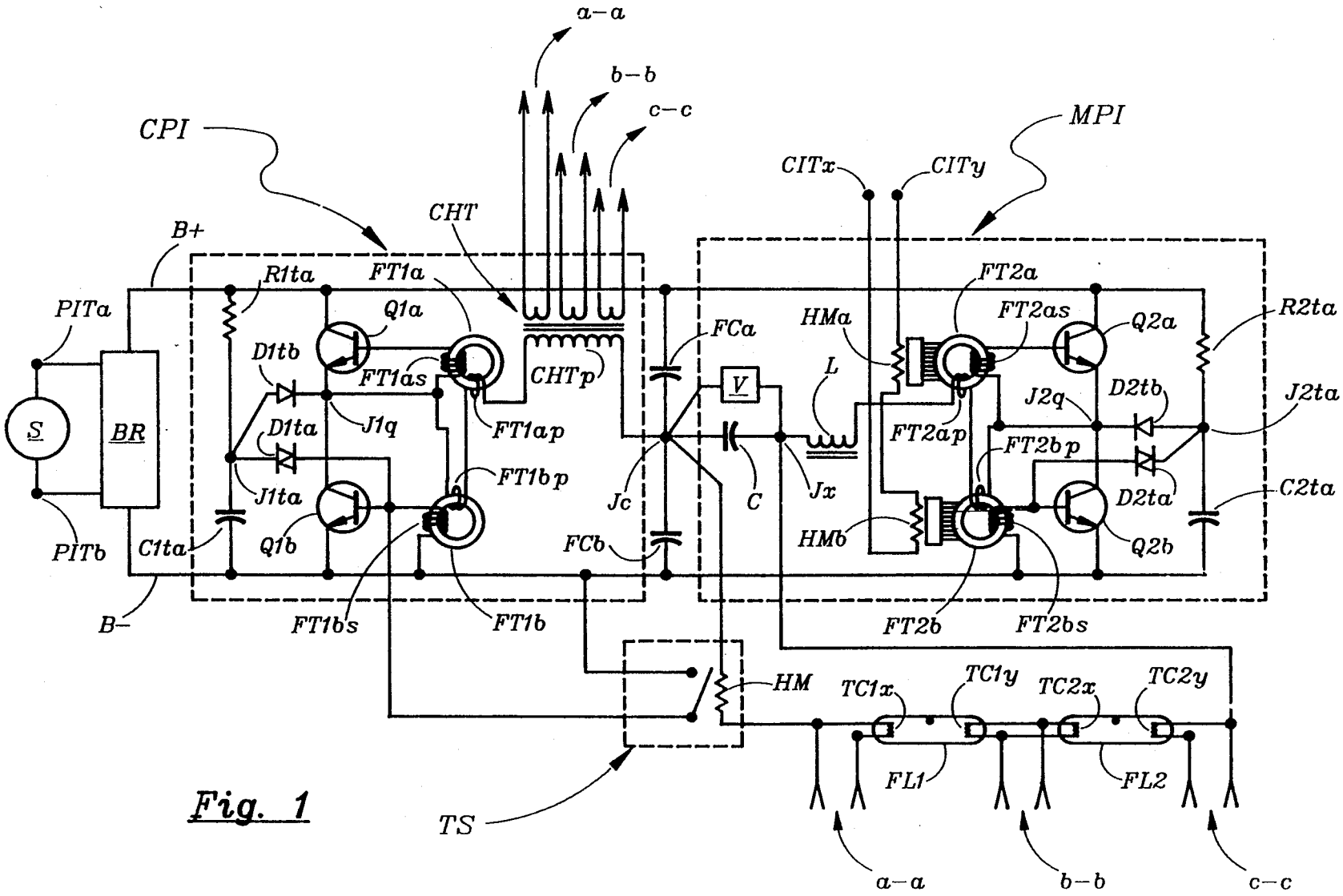
FIG. 1 provides a basic electrical circuit diagram of the preferred embodiment of the invention.

FIG. 1 schematically illustrates the electrical circuit arrangement of the preferred version of the present invention.

In FIG. 1, a source S of ordinary 277 Volt/60 Hz power line voltage is applied to power input terminals PITa and PITb; which terminals, in turn, are connected with a bridge rectifier BR. The DC output from bridge rectifier BR is applied to a B+ bus and a B- bus, with the B+ bus being of positive polarity.

A first filter capacitor FCa is connected between the B+ bus and a junction Jc; and a second filter capacitor FCb is connected between junction Jc and the B- bus.

A switching transistor Q1*a* is connected with its collector to the B+ bus and with its emitter to a junction Jlq.

A switching transistor Q1*b* is connected with its collector to junction Jlq and with its emitter to the B- bus.

A saturable current feedback transformer FTla has a primary winding FTlap and a secondary winding FTlas, which secondary winding is connected across the base-emitter junction of transistor Q1*a*.

A saturable current feedback transformer FTlb has a primary winding FTlbp and a secondary winding FTlbs, which secondary winding is connected across the base-emitter junction of transistor Q1*b*.

A resistor Rlta is connected between the B+ bus and a junction Jlta; a capacitor Clta is connected between junction Jlta and the B- bus; a Diac Dlta is connected between junction Jlta and the base of transistor Q1*b*; and a diode Dltb is connected with its anode to junction Jlta and with its cathode to junction. J1*q*.

Connected between junction Jc and Jlq, by way of primary windings FTlap and FTlbp of feedback transformers FTla and FTlb, is primary winding CHTp of a cathode heating transformer CHT; which cathode heating transformer has three secondary windings with output terminals a—a, b—b and c—c.

The circuit principally consisting of transistors Q1*a* and Q1*b*, feedback transformers FTla and FTlb, trigger elements Rlta, Clta, Dlta and Dltb, and cathode heating transformer CHT is referred to as cathode power inverter CPI.

A switching transistor Q2*a* is connected with its collector to the B+ bus and with its emitted to a junction J2*q*.

A switching transistor Q2*b* is connected with its collector to junction J2*q* and with its emitter to the B- bus.

A saturable current feedback transformer FT2*a* has a primary winding FT2ap and a secondary winding FT2as, which secondary winding is connected across the base-emitter junction of transistor Q2*a*.

A saturable current feedback transformer FT2*b* has a primary winding FT2bp and a secondary winding FT2bs, which secondary winding is connected across the base-emitter junction of transistor Q2*b*.

A resistor R2ta is connected between the B+ bus and a junction J2ta; a capacitor C2ta is connected between junction J2ta and the B- bus; a Diac D2ta is connected between junction J2ta and the base of transistor Q2*b*; and a diode D2tb is connected with its anode to junction J2ta and with its cathode to junction J2*q*.

Connected between junction J2*q* and a junction Jx, by way of primary windings FT2ap and FT2bp of feedback transformers FT2*a* and FT2*b*, is an inductor L; and connected between junction Jx and junction Jc is a capacitor C, as well as a Varistor V.

The circuit principally consisting of transistors Q2*a* and Q2*b*, feedback transformers FT2*a* and FT2*b*, trigger elements R2ta, C2ta, D2ta and D2tb, inductor L, capacitor C, and Varistor V is referred to as main power inverter MPI.

A normally open bistable thermal switch TS is connected with its switched terminals across the base-emitter junction of transistor Q1*b*. Thermal switch TS is activated by a low-resistance heating means HM that is thermally connected therewith.

Two fluorescent lamps FL1 and FL2 are series-connected across junctions Jc and Jx by way of the low-resistance heating means HM.

Fluorescent lamp FL1 has thermionic cathodes TC1*x* and TC1*y*; and fluorescent lamp FL2 has thermionic cathodes TC2*x* and TC2*y*. The terminals of cathode TC1*x* are connected with terminals a—a of transformer CHT; the terminals of cathodes TC1*y* and TC2*x* are connected in parallel with terminals b—b of transformer CHT; and the terminals of cathode TC2*y* are connected with terminals c—c of transformer CHT.

Series-connected heating means HMa and HMb are electrically connected with control input terminals CITx and CITy, and thermally connected with saturable feedback transformers FT2*a* and FT2*b*, respectively.

Details of Operation

In their basic operation, half-bridge inverters CPI and MPI are substantially conventional. Their basic operation is explained in detail in conjunction with FIG. 8 of U.S. Pat. No. Re. 31,758 to Nilssen.

When power is initially applied to power input terminals PITa and PITb of FIG. 1, inverter CPI is triggered into oscillation within a very brief period, typically a few milliseconds long. The exact length of this period is principally determined by the values of resistor Rtla and capacitor Ctla.

As soon as inverter CPI starts to oscillate, cathode heating power begins to be supplied, by way of the three secondary windings on transformer CHT, to the cathodes of fluorescent lamps FL1 and FL2. After about 1.5 second, the cathodes are thermionic and the lamps are ready to be ignited. At that point in time, inverter MPI is triggered into oscillation.

The time at which inverter MPI is initially triggered into oscillation is principally determined by the values of resistor R2ta and capacitor C2ta; which time is chosen to be about 1.5 seconds after the initiation of inverter CPI.

Since inductor L and capacitor C are resonant at or near the oscillation frequency of inverter MPI, a relatively high-magnitude high-frequency sinusoidal voltage develops across capacitor C, thereby igniting the fluorescent lamps. Since the lamp cathodes are fully incandescent at this point in time, lamp ignition occurs almost immediately after inverter MPI starts oscillation.

After ignition, the magnitude of the current flowing through the lamps is determined by the exact value of the inverter's oscillation frequency; which, in turn, is determined by the temperature of the ferrite cores in the saturable feedback transformers FT2*a* and FT2*b*. This temperature, in turn, is determined by the amount of power provided to heating means HMa and HMb from control input terminals CITx and CITy.

Details in respect to the effect of core temperature on the inverter's oscillation frequency are provided in U.S. Pat. No. 4,513,364 to Nilssen.

Thus, by adjusting the magnitude of a control voltage provided at control input terminals CITx and CITy, a corresponding adjustment of the inverter's oscillation frequency results; which, in turn, provides for a corresponding adjustment of the light output from the fluorescent lamps.

The arc current flowing through the lamps is also flowing through the low-resistance heating means HM, thereby providing heat to thermal switch TS—the amount of heat being proportional to the square of the RMS magnitude of the lamp arc current.

At maximum flow of lamp arc current, which corresponds to maximum light output, the amount of heat generated by heating means HM is sufficient to cause thermal switch TS to close, thereby preventing inverter CPI from oscillating; which, in turn, removes the cathode heating power from the lamps cathodes.

At or below some given reduced flow of lamp arc current —which reduced flow would be the result of supplying at least a certain amount of power to the control input terminals—the amount of heat generated in heating means HM is insufficient to keep the thermal switch closed. Thus, at or below this predetermined degree of reduced lamp arc current, thermal switch TS opens, thereby to cause inverter CPI to start oscillating and to start providing cathode heating power again.

However, if at a later time the magnitude of the lamp arc current is brought back above the predetermined level, the thermal switch again closes, thereby again eliminating the supply of cathode heating power.

Additional Comments a) More detailed information relative to a fluorescent lamp ballast wherein the fluorescent lamp is powered by way of a series-excited parallel-loaded L-C resonant circuit is provided in U.S. Pat. No. 4,554,487 to Nilssen.

One effect of such a ballasting arrangement is that of making the waveshape of the voltage provided across the output to the fluorescent lamps very nearly sinusoidal, even though the output from the inverter itself (MPI), at the input to the series-resonant L-C circuit, is basically a squarewave.

b) The thermal switch (TS) is of well known design. It is made to have two stable states and to switch between these two states in bi-stable manner. State No. 1, which is the state shown in FIG. 1 (open), represents the state- into which the switch will enter and wherein it will remain in the absence of adequate amount of power being applied to its built-in heating means (HM). State No. 2 represents the state (closed) into which the switch will enter and where it will remain in the presence of an adequate amount of power being applied to its heating means.

c) It is believed that the present invention and its several attendant advantages and features will be understood from the preceding description. However, without departing from the spirit of the invention, changes may be made in its form and in the construction and interrelationships of its component parts, the form herein presented merely representing the presently preferred embodiment.

I claim:

1. An arrangement comprising:

rectifier means operative to connect with an ordinary electric utility power line and, when so connected, to provide a DC voltage at a set of DC terminals;

first inverter means connected with the DC terminals and operative in response to the DC voltage to provide an arc current from a first set of output terminals;

second inverter means connected with the DC terminals and operative in response to the DC voltage to provide cathode heating power from a second set of output terminals, the second inverter means having control means operable in response to the magnitude of the arc current to control the magnitude of the cathode heating power; and fluorescent lamp means having arc terminals and cathode terminals, the arc terminals being operative to connect with and to receive the arc current from the first set of output terminals, the cathode terminals being operative to connect with and to receive the cathode heating power from the second set of output terminals;

whereby the fluorescent lamp means is: i) provided with arc current from the first inverter means, and ii) controllably provided with cathode heating power from the second inverter means.

2. The arrangement of claim 1 wherein the amount of cathode heating power is reduced whenever the magnitude of the arc current exceeds a certain predetermined level for a period of time.

3. The arrangement of claim 1 wherein the first inverter means comprises delay means operative, when the first and the second inverter means are initially supplied with the DC voltage, to delay the provision of the arc current until after cathode heating power has been provided for some period of time.

4. The arrangement of claim 1 wherein the amount of cathode heating power is diminished some time after the arc current has started to flow.

5. The arrangement of claim 1 wherein the first inverter means comprises adjust means operative in response to ad adjust input to cause adjustment of the frequency of the arc current.

6. The arrangement of claim 5 wherein the first inverter means comprises frequency-responsive impedance means operative to cause the magnitude of the arc current supplied to the arc terminals from the first set of output terminals to depend upon the frequency of the arc current, thereby to permit adjustment of the magnitude of the arc current by way of providing an adjust input to the adjust means.

7. The arrangement of claim 6 wherein the magnitude of the arc current is applied as the control input to the control mans of the second inverter, thereby making the amount of cathode heating power provided from the second inverter means responsive to the magnitude of the arc current.

8. The arrangement of claim 7 wherein the amount of cathode heating power is diminished whenever the magnitude of the arc current exceeds a predetermined level longer than a certain period of time.

9. The arrangement of claim 1 wherein said second inverter means comprises an inverter capable of self-oscillation.

10. The arrangement of claim 9 wherein said first inverter means comprises an inverter capable of self-oscillation.

11. The arrangement of claim 1 wherein the first inverter means comprises an inverter operative to provide a squarewave voltage at a pair of inverter output terminals and wherein an L-C series-combination including an inductor and a capacitor is connected across the inverter output terminals.

12. The arrangement of claim 11 wherein the L-C series-combination is series-resonant at or near the frequency of the squarewave voltage.

13. The arrangement of claim 1 wherein the arc current is substantially sinusoidal in waveform.

14. An arrangement comprising:

rectifier means operative to connect with the power line voltage of an ordinary electric utility power line and, when indeed so connected, to provide a DC voltage at a set of DC terminals;

first source means connected with the DC terminals and operative to provide a substantially continuous sinusoidal arc current from a first set of output terminals; the fundamental frequency of the arc current being higher than about 10 kHz; the first source means being characterized by including an L-C circuit resonant at or near the fundamental frequency of the arc current;

second source means connected with the DC terminals and operative provide cathode heating power from a second set of output terminals; the second source means having control means operable to permit control of the magnitude of the cathode heating power; the control action being derived from the arc current and being a function of the magnitude thereof; and gas discharge lamp means having arc terminals and cathode terminals; the arc terminals being operative to connect with and to receive the arc current from the first set of output terminals; the cathode terminals being operative to connect with and to receive the cathode heating power from the second set of output terminals;

whereby the fluorescent lamp means is: (a) provided with arc current from the first source means; and (b) provided with cathode heating power from the second source means in such manner that the magnitude of the cathode heating power will: (i) exceed a predetermined level whenever the magnitude of the arc current fails to exceed a certain level, and (ii) be substantially lower than said predetermined level whenever the magnitude of the arc current does exceed said certain level.

15. The arrangement of claim 14 wherein: (a) the first source means includes adjustment means operative to permit adjustment of the frequency and thereby the magnitude of the arc current; and (b) the control means is operative to cause the magnitude of the cathode heating power to be: (i) diminished substantially each time the magnitude of the arc current is adjusted to be higher than said certain level, and (ii) increased substantially each time the magnitude of the arc current is adjusted to be lower than said certain level.

16. The arrangement of claim 14 wherein the control means is operative: (i) to cause the cathode heating power to be provided whenever the magnitude of the arc current fails to exceed said certain level; and (ii) to reduce the magnitude of the cathode heating power whenever the magnitude of the arc current is caused to increase beyond said certain level.

17. An arrangement comprising:

a source providing a DC voltage at a pair of DC terminals;

converter means connected with the DC terminals and operative to provide: (i) a continuous substantially sinusoidal high-frequency arc current from a first set of output terminals, and (ii) cathode heating power from a second set of output terminals; the converter means having adjustment means operative to permit, in response to an electric control action, adjustment of the magnitude of the arc current; and gas discharge lamp means having arc terminals and cathode terminals; the arc terminals being connected with the first set of output terminals and being operative to receive the arc current therefrom; the cathode terminals being connected with the second set of output terminals and being operative to receive the cathode heating power therefrom;

whereby the gas discharge lamp means is: (a) provided from the first set of output terminals with a continuous flow of arc current of adjustable magnitude; and (b) provided from the second set of output terminals with cathode heating power in such manner that the magnitude of the cathode heating power will: (i) be higher than a predetermined level whenever the magnitude of the arc current is adjusted below a certain level, and (ii) be substantially lower than said predetermined level whenever the magnitude of the arc current is adjusted above said certain level.

18. An arrangement comprising:

a gas discharge lamp having a pair of arc terminals and a pair of cathode terminal connected with a thermionic cathode; the cathode terminals being characterized by having therebetween a cathode load impedance; the cathode load impedance being defined as the impedance represented by the thermionic cathode as observed from the cathode terminals;

a source having a first and second pair of output terminals; the first pair of output terminals being connected with the arc terminals; the second pair of output terminals: (i) being characterized by having a cathode source impedance, the cathode source impedance being defined as the internal impedance exhibited by the second pair of output terminals, and (ii) being connected with the cathode terminals; the source being operable to provide a non-interrupted substantially sinusoidal arc current of adjustable magnitude to the arc terminals and a cathode heating voltage of adjustable magnitude to the cathode terminals; the arc current having a frequency of at least 10 kHz; and control means connected in circuit with the source and operable to control the magnitude of the cathode heating voltage such that: (i) it is higher than a certain level whenever the magnitude of the arc current is adjusted to be lower than predetermined level; and (ii) it is substantially lower than said certain level whenever the magnitude of the arc current is adjusted to be higher than said predetermined level.

19. The arrangement of claim 18 wherein said certain level is substantially equal to zero.

20. An arrangement comprising:

a source providing a DC voltage at a pair of DC terminals;

converter means connected with the DC terminals and operative to provide: (i) a substantially continuous flow of high-frequency arc current form a first pair of terminals, and (ii) cathode heating power from a second set of terminals; the converter means having adjustment means operative to effect adjustment of the magnitude of the arc current in response to an electric control action; and gas discharge lamp means having arc terminals and cathode terminals; the arc terminals being connected with the first set of output terminals and being operative to receive the arc current therefrom; the cathode terminals being connected with the second set of output terminals and being operative to receive the cathode heating power therefrom;

the arrangement being operative to causes the cathode heating power to be: (i) higher than a predetermined level whenever the magnitude of the arc current is adjusted below a certain level, and (ii) substantially lower than said predetermined level whenever the magnitude of the arc current is adjusted above said certain level.

* * * * *